US007682270B2

(12) United States Patent
De Buyer-Mimeure

(10) Patent No.: US 7,682,270 B2
(45) Date of Patent: Mar. 23, 2010

(54) KNIFE AND DEVICE FOR REMOVING AN ARCHERY ARROW OR ARROWHEAD FROM A RECEIVING SUPPORT

(76) Inventor: Edouard De Buyer-Mimeure, 22 La Bertrandiere, l'Etrat, F-42580 (FR)

( * ) Notice: Subject to any disclaimer, the term of this patent is extended or adjusted under 35 U.S.C. 154(b) by 221 days.

(21) Appl. No.: 11/569,694

(22) PCT Filed: Apr. 15, 2005

(86) PCT No.: PCT/FR2005/050244

§ 371 (c)(1),
(2), (4) Date: Apr. 6, 2007

(87) PCT Pub. No.: WO2005/118234

PCT Pub. Date: Dec. 15, 2005

(65) Prior Publication Data

US 2007/0209182 A1 Sep. 13, 2007

(30) Foreign Application Priority Data

May 28, 2004 (FR) ..... 04 51063

(51) Int. Cl.
*F42B 6/04* (2006.01)
*B66F 3/00* (2006.01)

(52) U.S. Cl. ..... 473/578; 30/123; 294/102.1; 294/103.1

(58) Field of Classification Search ..... 473/578; 30/1, 123, 142, 143, 9.4, 491; 81/118, 158, 81/166, 170, 491; 294/102.1, 103.1
See application file for complete search history.

(56) References Cited

U.S. PATENT DOCUMENTS

| | | | | |
|---|---|---|---|---|
| 2,640,167 | A * | 5/1953 | Atlee et al. | 378/139 |
| 3,171,178 | A * | 3/1965 | Smith et al. | 248/316.3 |
| 3,873,058 | A | 3/1975 | Allen | |
| 3,873,068 | A * | 3/1975 | Allen | 254/131 |
| 4,028,758 | A | 6/1977 | O'Connor | |
| 4,622,707 | A * | 11/1986 | Finn | 7/158 |
| 5,102,100 | A * | 4/1992 | Troncoso, Jr. | 254/129 |
| 5,205,541 | A * | 4/1993 | Roberts et al. | 254/131 |
| 5,301,924 | A * | 4/1994 | Kammerer | 254/131 |
| 5,445,424 | A * | 8/1995 | Binette | 294/1.1 |
| 5,546,621 | A * | 8/1996 | Bulot | 7/138 |
| 6,854,776 | B2 * | 2/2005 | Downing | 294/1.1 |
| 7,415,745 | B2 * | 8/2008 | Rivera | 7/128 |
| 2003/0074776 | A1 | 4/2003 | Miles | |
| 2007/0209121 | A1 * | 9/2007 | Rivera | 7/128 |
| 2007/0209182 | A1 * | 9/2007 | De Buyer-Mimeure | 29/264 |

* cited by examiner

*Primary Examiner*—William M Pierce
(74) *Attorney, Agent, or Firm*—Heslin Rothenberg Farley & Mesiti P.C.

(57) ABSTRACT

A device to remove an archery arrow or arrowhead from a target or receiving support is fitted to a knife at one or more suitable points and comprises a gripper which can be fitted to and/or receive an archery arrowhead or arrow that penetrates the target or the receiving support. The device installed on a knife is employed to grip the arrow or arrowhead so that the knife can be pivoted like a lever such that the tip of the knife rests on the target or receiving support. In this way, the arrow or arrowhead can be removed by tilting the knife.

10 Claims, 5 Drawing Sheets

KNIFE AND DEVICE FOR REMOVING AN ARCHERY ARROW OR ARROWHEAD FROM A RECEIVING SUPPORT

CROSS REFERENCE TO RELATED APPLICATIONS

This is a Section 371 filing of International Application PCT/FR2005/050244, filed on Apr. 15, 2005, and published, in French, as International Publication No. WO 2005/118234 A1 on Dec. 15, 2005, and claims priority of French Application No. 0451063, filed on May 28, 2004, which applications are hereby incorporated by reference herein, in their entirety.

BACKGROUND ART

The invention relates to the technical field of equipment for archery and associated accessories.

When the archer shoots, he or she releases an arrow that strikes a target at high velocity, the nature of the target being possibly animal or vegetable and, in the latter case, the target is made of wood or is even a tree trunk. The impact depth is several millimetres or even several centimetres, depending on the nature of the receiving support, the power of the bow and the type of arrow and arrowhead used.

The problem encountered is the fact that, as far as the applicant is aware, there is no suitable tool or mechanism for recovering the arrow by removing it from the receiving support.

It is observed, in practice, that extraction is not easy and causes either deformation of the arrow or it is necessary to use a knife or similar tool to enlarge the opening around the area where the arrow struck in order to allow its removal. In practice, the archer often uses the tip of his or her knife to enlarge this opening. He or she thus risks damaging said arrowhead. The arrow may be made in one piece (bonded shaft and arrowhead) or in three parts (tube, insert and arrowhead). The arrowhead has a thread on which the end of the tubular part of the body of the arrow fits. Whatever the case, even if one can remove the body of the arrow, the arrowhead remains embedded in the receiving support and is still very difficult to get out.

The applicant's approach was therefore to give serious thought to this particular problem which is an extreme nuisance to him, especially when he is training and loses numerous arrows and/or arrowheads because of deformation or damage, this being, in the long-term, expensive, not to mention the damage it causes to targets and areas struck by arrows in particular.

The applicant's approach was therefore to devise a device that was simple to produce which could facilitate the removal of arrows and arrowheads without damaging them and without risk of damaging the tip of the knife or the receiving medium.

Another sought-after object of the invention was to use additional equipment available to the archer that had an acceptable cost price in relation to its usefulness and which was extremely practical for the archer when needed.

These objects and others will become apparent from the following description.

BRIEF SUMMARY OF THE INVENTION

According to a first aspect of the invention, the device for removing an archery arrow or arrowhead from its receiving support is distinctive in that said device can be fitted to a knife at one or more suitable points and comprises a means which can be fitted to and/or tightened around an archery arrow or arrowhead that penetrates a target or a receiving support and in that the knife is used to position the means or to tighten same around the arrow or arrowhead so that the knife can be pivoted like a lever such that the tip of the knife rests on the target or receiving area so that the arrow or arrowhead can be removed by tilting the knife.

These aspects and others will become apparent from the following description.

BRIEF DESCRIPTION OF THE FIGURES

The object of the present invention is described, merely by way of example, in the accompanying drawings in which.

DETAILED DESCRIPTION

Figure 1:
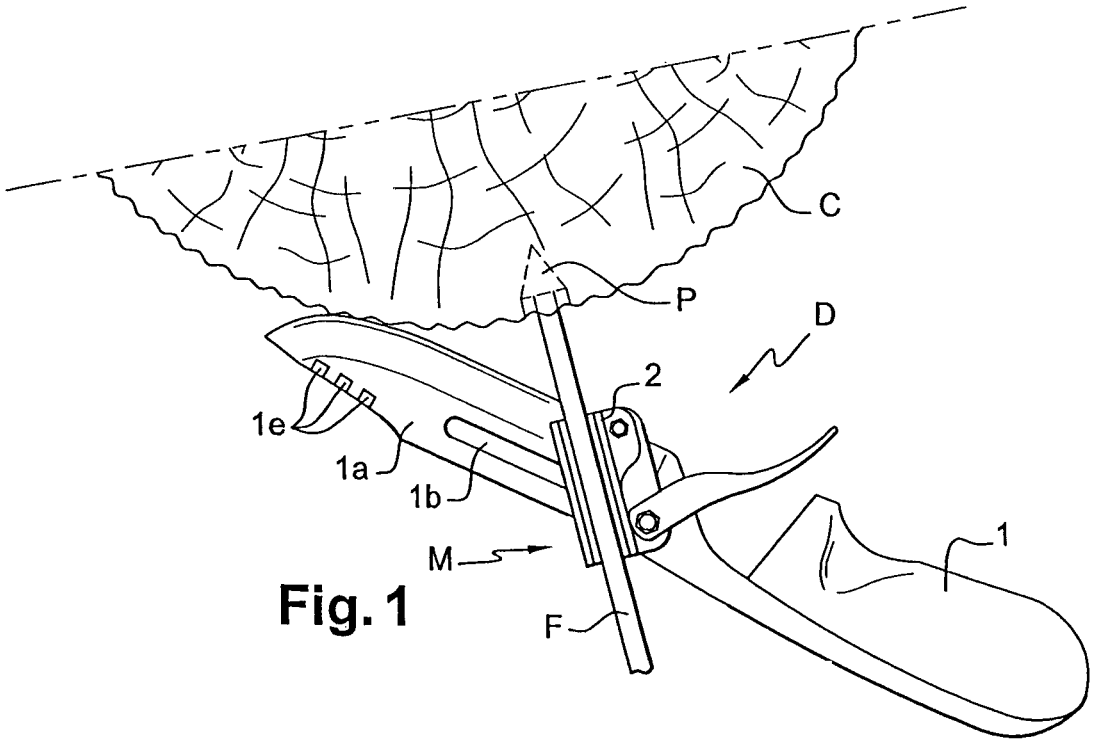
FIG. 1 is a view showing the device according to the invention in a first embodiment, the device being fitted to a knife blade specially designed for this purpose. In this Figure, the arrow is pre-positioned on the device and is shown before tightening. The assembly is shown prior to removing an arrow.

In order that the object of the invention may more readily be understood, the following description is given, merely by way of example, reference being made to the accompanying drawings.

The device (D) according to the invention can be fitted to a knife (1). The function of the device (D) according to the invention is to be fitted to a knife at one or more suitable points. It comprises a means (M) which can be fitted to and/or receive an archery arrow (F) or arrowhead (P) that penetrates a target (C) or a receiving support made of a material of any vegetable, wood, animal or other type whatsoever.

The device according to the invention is therefore used to position means (M) or tighten same around the arrow or arrowhead so that the knife can be pivoted like a lever such that the tip of the knife penetrates the target or receiving area of the arrow so that the arrow or arrowhead can be removed by tilting the knife.

There are several possible implementations.

A first embodiment is described below, reference being made to FIGS. 1 to 4. The device comprises a feature on blade (1*a*) of the knife with a least one opening in which a guide (2)

slides or rests on a pin (3), the guide being attached to the knife blade by means or a knurled knob (4). This opening can be an oblong opening (1*b*) in the actual blade itself or consist of one or more notches (1*e*) formed on the upper edge of the blade allowing movement of pin (3) of the above-mentioned guide. Guide (2) has two components, namely a fixed base plate (2*a*), with a vertical wing (2*a*1) and movable jaws (5) articulated on pin (6), said jaws having a vertical wing (5*a*) intended to move up against wing (2*a*), together defining a cradle or tube for positioning arrow (F). These movable jaws are capable of positioning and clamping the arrow against wing (7) forming a cam mounted on a pin (8) joined to the above-mentioned base plate. When the jaws are opened, FIG. 1, i.e. in order to position arrow (F), the jaws formed by the cradle shape between wings (2*a*1) and (5*a*) leaves sufficient room to allow positioning of the tubular body of the arrow. Actuating operating control (7) relative to its pin (8) causes displacement of movable jaws (5) which clamps the tubular body of the arrow in the guide.

Figure 2:
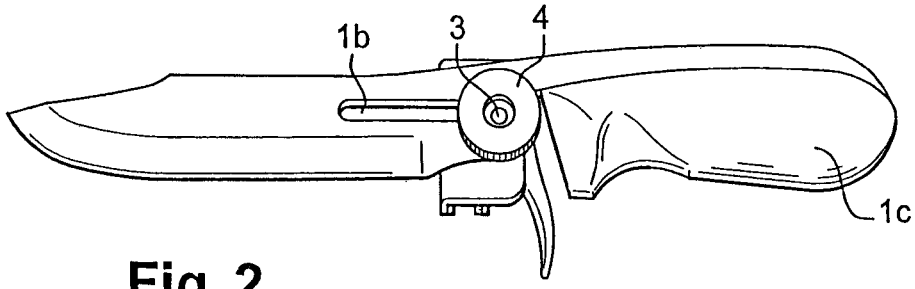
FIG. 2 is a rear view of the knife on which a first version of the device according to the invention is fitted, before tightening.
Figure 3:
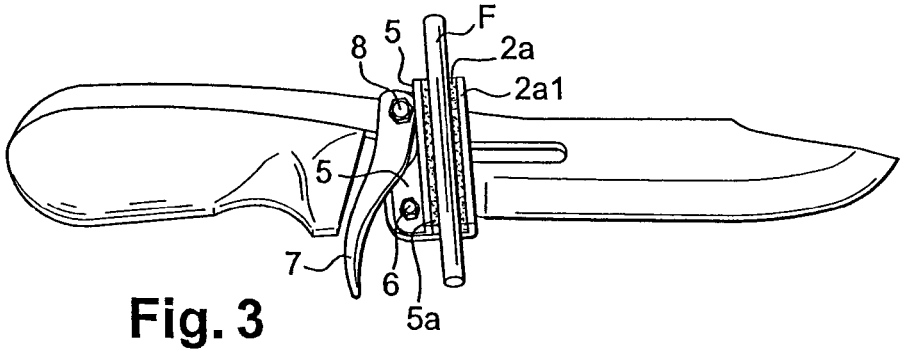
FIG. 3 is a front view of the device in FIG. 2 with the arrow being held in position after tightening.
Figure 4:
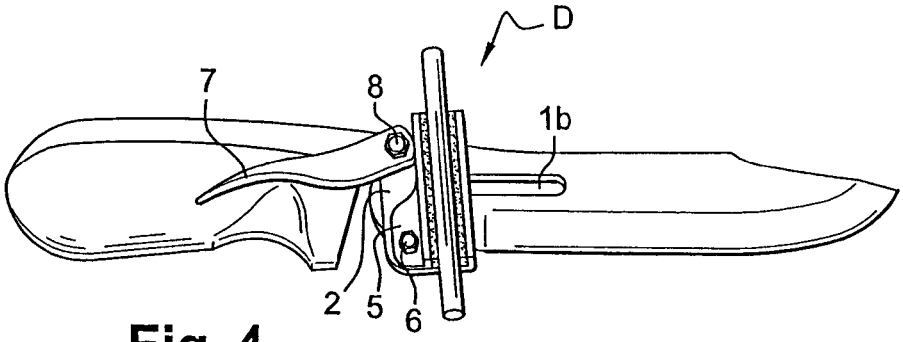
FIG. 4 is a view according to FIG. 3 showing the device according to the invention before tightening.
Figure 6:
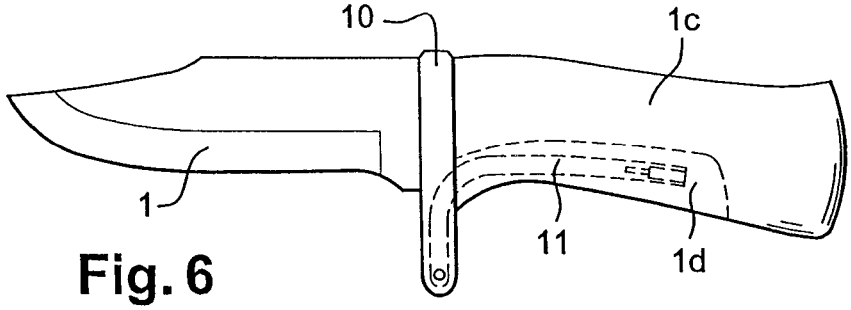
FIG. 6 is a view, according to FIG. 5, in which the device is stowed in the knife.

In this situation, FIG. 2, the guide is perfectly tightened around the arrow and the knife is in a plane that is substantially perpendicular to the arrow which is embedded in the receiving support or target. To ensure removal of the arrow from its temporary support, the associated guide and knife must be positioned on the body of the arrow at a point that is sufficiently close to the receiving support in order to allow pivoting of the knife by its handle (1*c*), thus providing efficient leverage and placing the tip of the knife against the target so as to create a fulcrum that makes it possible, by tilting, to remove the arrow from the corresponding impact area.

FIGS. 1 to 4 show the embodiment of the invention.

Figure 8:
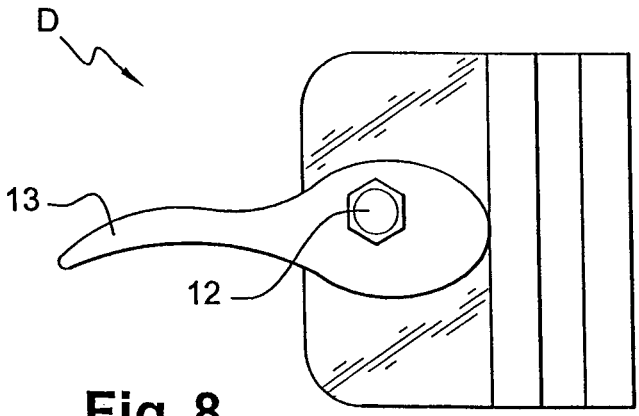
FIG. 8 is a plan view of the version of the device in FIGS. 1 to 4.
Figure 9:
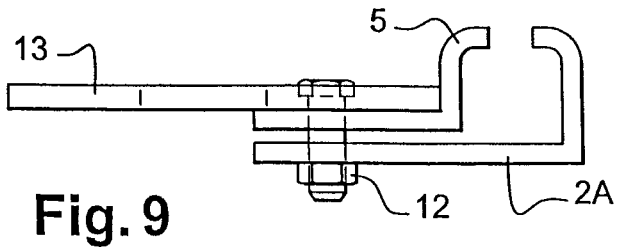
FIG. 9 is a profile view of the version in FIG. 8.

In one version of this first principle (see FIGS. 8 and 9), the base plate (2*a*) remains unchanged, jaws (5) remain similar but there is a single pin (12) that ensures linkage with operating lever (13) that acts as a cam. Pin (12) is off centered relative to the support surface of said lever so as to produce uniform thrust over the entire jaws. This provides a uniform thrust effect. Note that, depending on the two embodiments, the duct or tube that accommodates arrows takes arrows of different diameters. The travel of the lever and the associated cam position are adapted to match this diameter.

Figure 5:
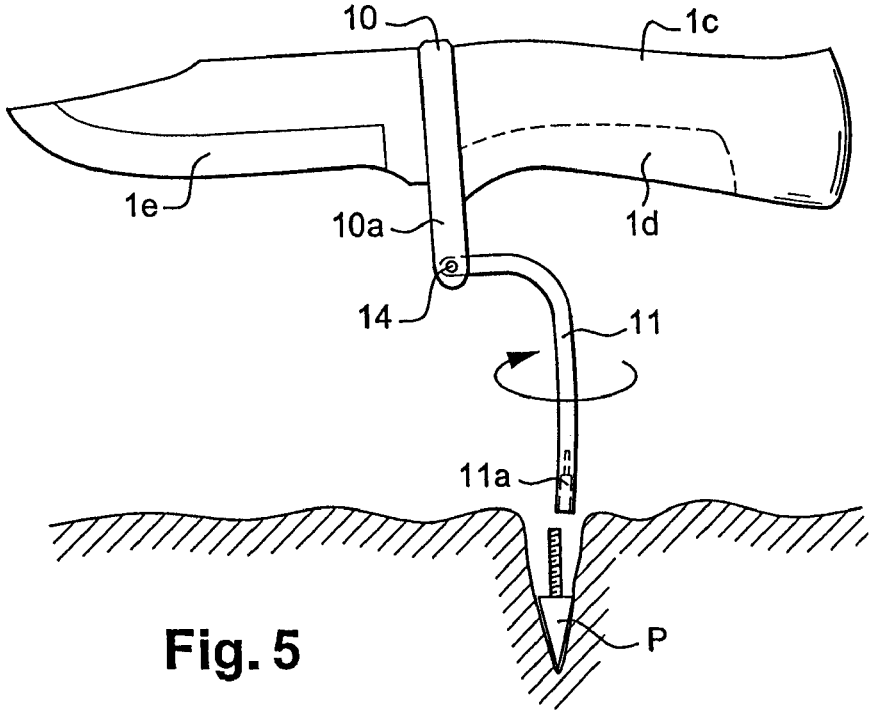
FIG. 5 is a view of a second version of the device fitted to a knife prior to its use.
Figure 7:
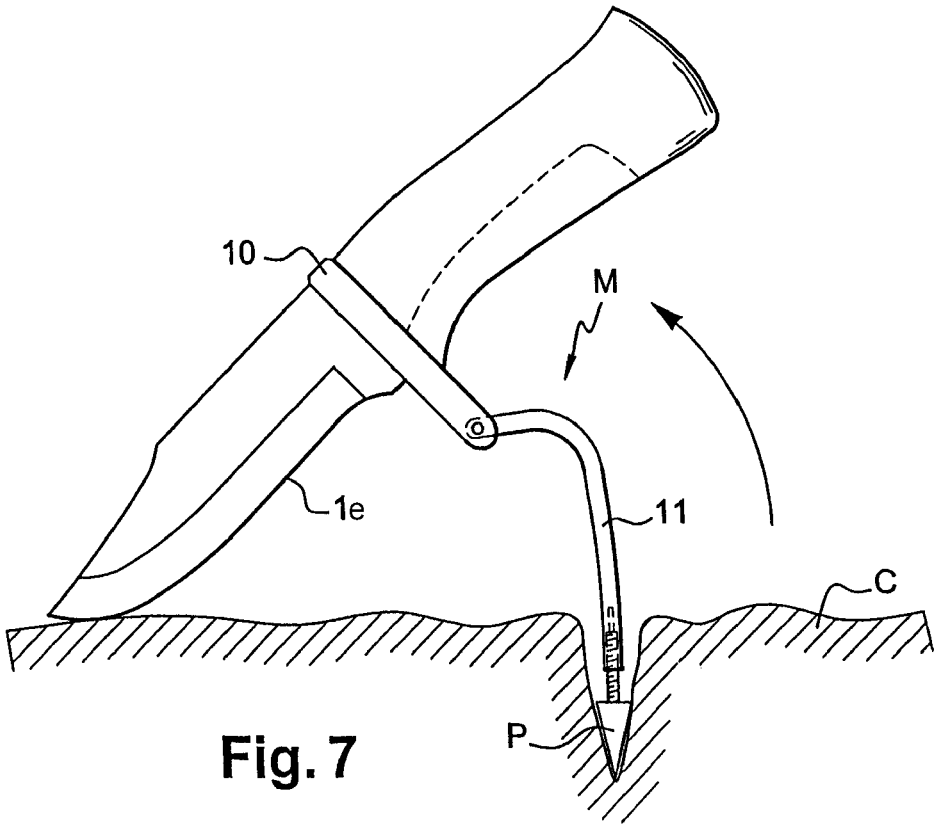
FIG. 7 is a schematic view showing attachment of the device to an arrowhead embedded in a receiving support.
Figure 10:
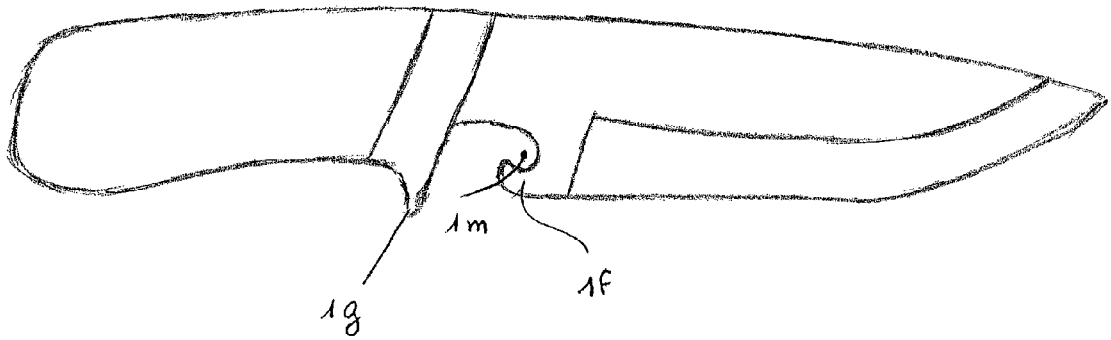
FIG. 10 is a view of the knife with a different version.
Figure 11:
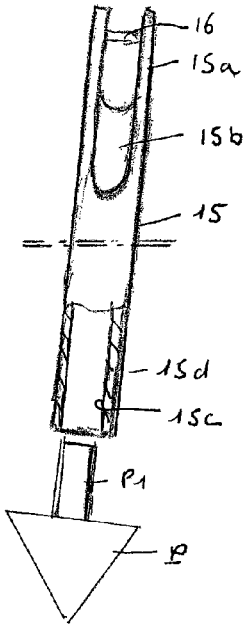
FIG. 11 is a front view of the connecting piece that forms a lever with its lower part partially cut away.
Figure 12:
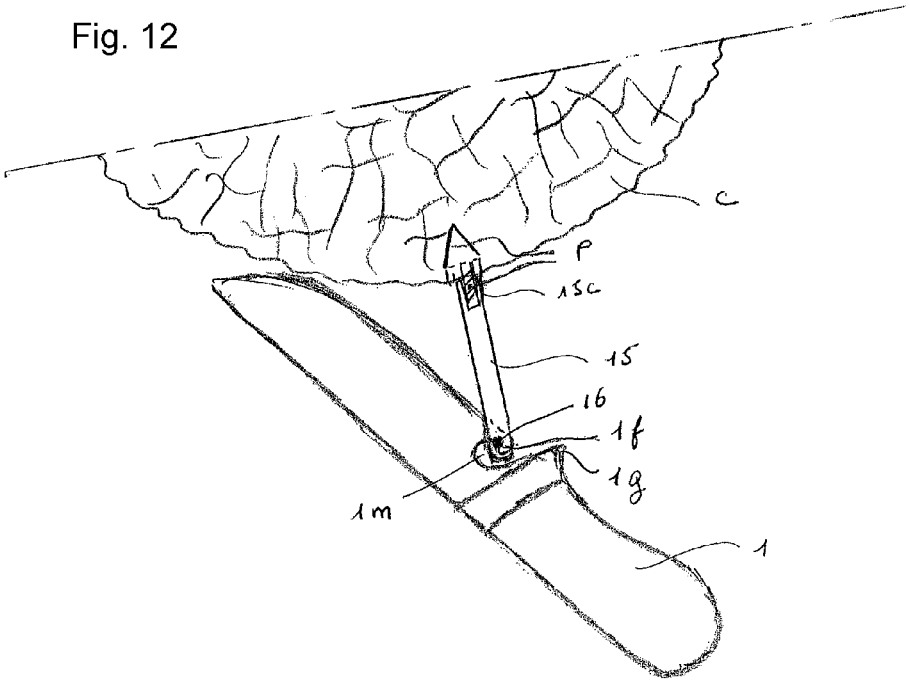
FIG. 12 is a view according to FIG. 11 showing positioning of the connecting piece that forms a lever.
Figure 13:
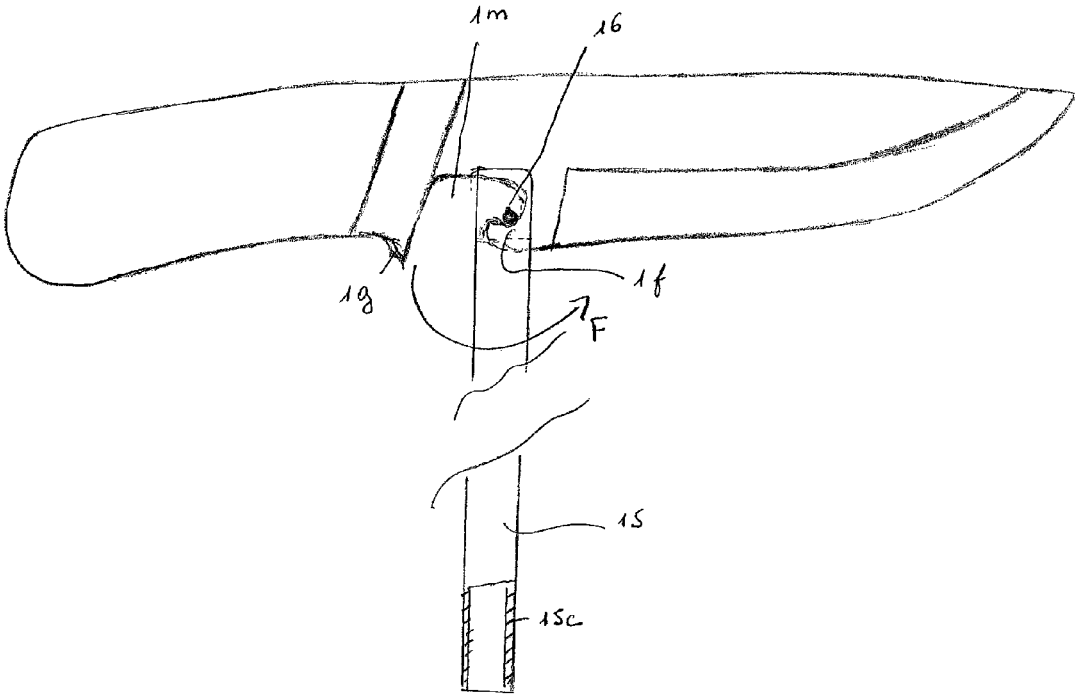
FIG. 13 is a view showing positioning of the knife with the version in FIGS. 10 and 12, prior to removing an arrow.

In another alternative embodiment shown in FIGS. 5 to 8 the knife itself (1) is not modified, i.e, the blade has no cut-out or notches. In the area where the shank and the handle join, the knife accommodates a guard (10), the lower end (10*a*) of which protrudes and is capable of accommodating an extraction rod (11) that can be bent and articulated on a pin (14) located on the guard. Said rod has, on its free end, an internal thread (11*a*) capable of mating with arrowhead (P) after removal of the actual arrow (F). The handle of the knife has an internal cavity (1*d*) capable of enclosing above-mentioned extraction rod (11) in order not to obstruct gripping of the knife during normal use. FIGS. 5 and 7, show extraction of the arrowhead after prior removal of the arrow. This is obtained by mating the internal threaded part of the extraction rod to the end of said arrowhead. With the extraction rod thus positioned, being substantially vertical relative to the plane that receives the arrow or arrowhead, it is sufficient to tilt the knife in the direction shown in FIG. 7 so that its cutting part (1*e*) and its end press against the receiving target of the arrow, in order to create leverage thereby removing the arrow or arrowhead under the above-mentioned conditions.

Another alternative embodiment is shown in FIGS. 10, 11, 12 and 13. In this case, the knife is designed with means (M) which is in the form of a curved lip (1*f*) located between the blade and guard (1*g*) of the knife which reveals an inward opening (1*m*). This curved lip makes it possible to attach and articulate a joining piece (15), the front end of which is shaped like a clevis (15*a*) with a suspension spacer pin (16) capable of fitting into the lower part of the curved lip. In order to allow articulation of this joining piece in the direction of arrow (F) shown in FIG. 13, this piece is designed with an extended, deep clevis-shape (15*a*) in order to provide an axially recessed area (15*b*) making it easy to engage the clevis part around the curved lip and pivot it. Angular swiveling of this connecting piece is limited by stopping by the guard or by the blade part of the knife. The other end (15*d*) of the connecting piece is threaded at (15*c*) to enable it to fit and screw onto the external thread (P1) of arrowhead (P) of the arrow under conditions similar to those shown in FIGS. 5 and 7. Operation takes place under conditions identical to those described previously, with connecting piece (15) providing leverage and the blade of the knife pushing against the opposite-facing part of the target.

The solution proposed by the applicant is therefore extremely simple to produce and very practical in use. Its cost price is affordable.

The two solutions can be used independently or be incorporated in a single knife that then has the dual features mentioned above.

The invention claimed is:

1. A device for removing an archery arrowhead from a receiving support or target, comprising a knife, and a component adapted to be fitted for articulation to the knife at one or more suitable points and adapted to be fitted to and/or receive an archery arrowhead that penetrates a target or a receiving support, and adapted to be attached by a threaded connection to an exposed end of the arrowhead so that the knife can be pivoted like a lever with a tip of the knife penetrating the target or receiving support, whereby the arrowhead can be removed by tilting the knife about the tip.

2. A device for removing an archery arrowhead or arrow from a receiving support or target, comprising a knife and a component adapted to be fitted to the knife at one or more suitable points and adapted to be fitted to and/or receive an archery arrow or arrowhead that penetrates a target or a receiving support, and adapted to be attached to the arrow or arrowhead so that the knife can be pivoted like a lever with a tip of the knife penetrating the target or receiving a support, wherein a blade of the knife has at least one opening and the component comprises a guide on a first pin that fits into said at least one opening, the guide being attached to the blade of the knife by a knurled knob, and wherein the guide includes a fixed base plate with a first wing, and movable jaws articulated on a second pin, said jaws having a second wing to move against the first wing, together defining a cradle or tube for receiving the arrow or arrowhead, whereby the arrow or arrowhead can be removed by tilting the knife about the tip.

3. A device as claimed in claim 2, wherein said opening is oblong and is located interior of the blade.

4. A device as claimed in claim 2, wherein said opening comprises one or more notches on an upper edge of the blade of the knife.

5. A device as claimed in claim 2, further comprising an operating control forming a cam mounted on a pin joined to the base plate, pivoting of the operating control causing the movable jaws to position and clamp a body of the arrow against the first wing.

6. A device as claimed in claim 2, wherein the jaws are mounted on the second pin in a manner that ensures connection to an operating lever acting as a cam, the second pin being off centered relative to a support surface of said lever so as to produce uniform thrust over the entire jaws.

7. A device as claimed in claim 1, wherein a blade of the knife is not modified, and, in an area where a shank and a handle join, the knife accommodates a guard, a lower end of the guard protrudes and accommodates a bent extraction rod articulated on a pin located on the guard, said rod has, on a free end, an internal thread for mating with the arrowhead after removal of the actual arrow, and the handle of the knife has an internal cavity for enclosing the extraction rod.

8. A device as claimed in claim 2 wherein said component is attached to an arrow by clamping a tubular body of the arrow in the guide.

9. A device as claimed in claim 1, wherein the knife has a curved lip and an inward opening located between a blade and a guard of the knife, and the curved lip makes it possible to attach and articulate a joining piece, a front end of the joining piece is shaped like a clevis with a suspension spacer pin and an other end of the joining piece is adapted for screwing onto an external thread of the arrowhead of the arrow, said joining piece functioning as a swivel lever.

10. A device as claimed in claim 9, wherein the joining piece has an extended, deep clevis with an axially recessed area allowing the joining piece to engage with and swivel around the curved lip.

* * * * *